US009187863B2

(12) United States Patent
Hogebrandt et al.

(10) Patent No.: US 9,187,863 B2
(45) Date of Patent: Nov. 17, 2015

(54) METHOD FOR THE CAUSTICIZING PROCESS FOR PRODUCING WHITE LIQUOR

(75) Inventors: Eva Hogebrandt, Karlstad (SE); Alessandra Labigalini Baranovsky, Curitiba-PR (BR)

(73) Assignee: Valmet AB, Sundsvall (SE)

( * ) Notice: Subject to any disclaimer, the term of this patent is extended or adjusted under 35 U.S.C. 154(b) by 89 days.

(21) Appl. No.: 14/355,265

(22) PCT Filed: Nov. 4, 2011

(86) PCT No.: PCT/SE2011/051317

§ 371 (c)(1),
(2), (4) Date: Sep. 5, 2014

(87) PCT Pub. No.: WO2013/066225

PCT Pub. Date: May 10, 2013

(65) Prior Publication Data

US 2014/0374039 A1 Dec. 25, 2014

(51) Int. Cl.

| | |
|---|---|
| ***D21C 11/00*** | (2006.01) |
| ***D21C 11/04*** | (2006.01) |
| ***D21C 3/02*** | (2006.01) |

(52) U.S. Cl.

CPC ..... *D21C 11/0078* (2013.01); *D21C 3/02* (2013.01); *D21C 11/0007* (2013.01); *D21C 11/0064* (2013.01); *D21C 11/04* (2013.01)

(58) Field of Classification Search

CPC ..... D21C 11/0042; D21C 11/0078; D21C 11/0064

See application file for complete search history.

(56) References Cited

U.S. PATENT DOCUMENTS

| | | | | |
|---|---|---|---|---|
| 4,929,355 | A | 5/1990 | Ragnegaard et al. | |
| 5,788,813 | A | 8/1998 | Engdahl et al. | |
| 2007/0251891 | A1 * | 11/2007 | Lownertz ..... | D21C 11/0064 210/791 |

OTHER PUBLICATIONS

Gullichsen editor, Chemical Pulping 6B, 1999, Fapet Oy, p. B150-B172.*

Wold David, High-quality white liquor the final ingredient in the chemical handling product mix, 2008, Metso Paper consumer magazine, vol. 10 Issue 2.*

Valmet, Valemt White Liquor Plant Technology, Oct. 29, 2014, West Canada Blurbac.*

Gu et al., Prediction of metals distribution in mill processes, Part 3 of 3:NPE management in kraft chemical recovery, 2004, Tappi Journal, vol. 3 No. 3, p. 9-15.*

Strid, K., Garelius, P., "A New Filter System for Filtration of Green and White Liquor" 1992 Pulping Conference, TAPPI Proceedings, 1992, pp. 1-5; whole document.

* cited by examiner

*Primary Examiner* — Anthony Calandra

(74) *Attorney, Agent, or Firm* — Rolf Fasth; Fasth Law Offices

(57) ABSTRACT

The method is for preparation of white liquor in a chemical recovery process of the kraft process. The green liquor separation process and the white liquor separation process are taking place in the same common filter apparatus with no dedicated green liquor separation apparatus or any dedicated white liquor separation apparatus. The white liquor separation process and the green liquor separation process are conducted in sequence in the same filter apparatus. The white liquor separation process has a part of the cycle time in the range 20-50% of the total cycle time in the same filter apparatus.

8 Claims, 7 Drawing Sheets

METHOD FOR THE CAUSTICIZING PROCESS FOR PRODUCING WHITE LIQUOR

PRIOR APPLICATION

This application is a U.S. national phase application that is based on and claims priority from International Application No. PCT/SE2011/051317, filed 4 Nov. 2011.

FIELD OF THE INVENTION

The present invention relates to a method for preparation of white liquor in a chemical recovery process of the kraft process. It affects the total system lay out of the causticizing process between input of raw green liquor and final production of a clear white liquor.

BACKGROUND OF THE INVENTION

The causticizing process has conventionally used a lot of different process steps for;

- reception of the green liquor;
- separation of dregs from green liquor;
- washing and drying dregs obtained from the previous separation step;
- mixing of clear green liquor and burnt lime in order to slake lime and start the causticizing reaction;
- tanks for completion of the causticizing reaction;
- separation of lime mud from white liquor;
- lime mud washing and drying.

A typical conventional causticizing process is shown in FIG. 1. The raw green liquor RGL is first received in an equalizing tank EQT and from there pumped to a first green liquor separation process, here shown as a green liquor pressurized disc filter GLF. The green liquor filter separates dregs from the raw green liquor and produces clear green liquor which is sent to a green liquor storage tank GLT. The clear green liquor is then sent, most often via a green liquor cooler GLC, to the slaker SL where burnt lime is mixed into the green liquor. The cooler is needed to reduce temperature ahead of the slaker to keep the slurry in the slaker under boiling point as the reactions occurring in and after the slaker are exothermic. Grits, i.e. unreacted fractions of the burnt lime, are also separated out from the slaker. After mixing in the slaker, the slurry is sent to a series of causticizing vessels CT1-CT2-CT3, often named the causticizing train, wherein the chemical causticizing reactions are completed. Once these causticizing reactions are completed, the slurry is pumped to a white liquor separation process, here shown as white liquor pressurized disc filter WLF. The white liquor filter separates lime mud from the caustiziced liquor and produces clear white liquor, which is sent to a white liquor storage tank WLT. The clear white liquor is then sent directly to be used in the kraft cooking or bleaching line, or alternatively via a polysulfide modification process to said kraft cooking. The lime mud, which still may have a residual content of alkali, is sent to a lime mud washing and drying stage, here shown as a lime mud pressurized disc filter LMF.

Once the lime mud is washed and dried it may be passed to the lime kiln in order to convert it to burnt lime to be used in the slaker again.

In these conventional causticizing processes as shown in FIG. 1, a specific start up procedure for the green liquor separation process has been used. During start up, the green liquor filter has initially been filled with causticizised liquor from the causticizing train CT1-CT2-CT3 in order to build up a precoat of lime mud on the surface of the filter cloth. The reason for this formation of lime mud precoat is that this precoat exhibit a far better separation efficiency than the cloth itself and has a better filterability than would a precoat formed by dregs from green liquor. The filterability improves by a factor of 6 if a precoat is formed by lime mud instead of green liquor mud (dregs). However, this short establishment of the precoat using causticizised liquor from the causticizing train CT1-CT2-CT3 has never been used for longer periods than about 5% of the total cycle time of the green liquor filter, and as soon as this precoat has been formed, the major part of the operating time for the green liquor filter has been used for green liquor filtering, and the main part of the white liquor produced, typically more than 90% of the total amount, is obtained from the dedicated white liquor filter.

However, usage of pressurized disc filters, one for white liquor filtration and one for green liquor filtration, are expensive as the costs for these filters are high. Filtering techniques are often better as cleaner product liquors could be obtained with small amounts of suspended solids in the product liquors, typically with content less than 20 ppm, as compared with typical green liquor having more than 1500 ppm. Another advantage is that dregs or lime mud separated from these filters could be obtained at very high dryness in the range 40-60% and 60-75% respectively. Alternative techniques has therefore been considered, and usage of conventional settling tanks for green liquor has once again been considered simply due to less investment costs, even though the amount of suspended solids often are much higher, typically four times more.

Another problem with these conventional processes is that so many different and dedicated separation apparatuses are needed, requiring a lot of free building area. This will be problematic when trying to increase capacity of the causticizing plant, as most often no available room is at hand for additional apparatuses increasing the capacity.

SUMMARY OF THE INVENTION

The invention is based upon the surprising finding that using a common separation process apparatus for white and green liquor separation will maintain a very efficient green liquor separation process as of reduced content of suspended solids, low residual alkali in dregs separated as well as high dryness in dregs. There is thus no need for a multitude of dedicated separation processes for white and green liquor.

The present invention also shows a method for simplification of the recausticizing process using far less separation apparatuses and thus may provide a solution for increasing capacity in any given available area not having the possibility of increasing the building area of the causticizing plant.

Another objective is to reduce the risk for down time. Normally the MTBF (mean time between failures) for the causticizing process will increase as the numbers of apparatuses needed in sequence in the process flow are decreased.

The invention will enable replacement of two separate and dedicated separation processes for white- and green liquor separation with only one separation process used for both the entire white- and green liquor separation. The new separation apparatus will have a slightly larger footprint area than one of the previously used separation apparatuses, but require far less foot print area than the two previous separation apparatuses put together. Even though buffer tanks preceding the common separation apparatus will increase in size, would the net foot print area be reduced in the system.

The method according to the invention is intended for preparation of white liquor in a chemical recovery process of the kraft process. Here the raw green liquor is first fed to a green liquor separation process wherein dregs are separated out and clear green liquor is obtained. Thereafter burnt lime is added to the clear green liquor in a slaker, followed by a causticizing train with a number of causticizing vessels wherein the causticizing process is finished producing causticized liquor. Thereafter the causticized liquor is sent to a white liquor separation process wherein lime mud is separated out and a clear white liquor is obtained to be used as cooking liquor in the kraft process either in form of the clear white liquor or as modified by polysulfide modification in a polysulfide process. The separated lime mud is sent to a lime mud washing and drying process before feeding the washed lime mud to a lime kiln. In this type of process the method is characterized in that the green liquor separation process and the white liquor separation process takes place in the same common filter apparatus with no dedicated green liquor separation apparatus nor any dedicated white liquor separation apparatus, and where the white liquor separation process and the green liquor separation process are conducted in sequence in the same filter apparatus and where the white liquor separation process has a part of the cycle time in the range 20-50% of the total cycle time in the same filter apparatus.

In order to maintain the flexibility of the process the method is further characterized in that an equalizing buffer tank is preceding the green liquor separation process and where the equalizing buffer tank has a storage capacity holding raw green liquor for at least 5 hours in said equalizing buffer tank, and where a last buffer tank in the causticizing train has a storage capacity holding a causticized liquor for at least 2 hours in said last buffer tank in the causticizing train. With this embodiment could the causticizing process be maintained even in case of any interruption in the dissolving tank (where green liquor is formed) or any interruption in the causticizing reaction process following the slaker operation.

In order to further improve the flexibility of the process, the method is further characterized in that the equalizing buffer tank is filled with raw green liquor while emptying the buffer tank in the causticizing train when performing the white liquor separation in the common filter apparatus, and thereafter emptying the equalizing buffer tank of raw green liquor while filling the buffer tank in the causticizing train when performing the green liquor separation in the common filter apparatus. By this alternating filling and emptying the buffer tanks the separation process can be in continuous operation producing the necessary volumes of both separated green and white liquors.

In order to use the buffer tanks as much as possible the method is further characterized in that the level of liquors in the buffer tanks are controlled within 20-95% of the total retention capacity during white and green liquor separation. A certain minimum content of liquor is needed to maintain a stabilizing volume in the equalizing tank as well as a minimum level for agitation in the buffer tank, and filling of buffer tanks should not reach a full 100% filling degree which may risk overflow of liquors and special handling actions for such overflow.

In order to improve formation of an optimal lime mud precoat with a minimum of residual dregs content, which content of dregs may reduce filterability, is the method further characterized in that the green liquor separation process in said common filter apparatus is ended by a complete emptying of raw green liquor and addition of an intensified wash out process using a volume of washing liquid of at least 5% of the liquor volume held in the common filter apparatus, said washing liquid not containing any dregs or lime mud particles, said intensified wash out process also entailing intense agitation in the liquid volume held in the common filter apparatus. In this context it would be beneficial for the volume of washing liquid used during the intensified wash out process to exceed 3 $m^3$ in most typical processes having a capacity of over 5300 $m^3$ green liquor per day and over 5000 $m^3$ white liquor per day. The wash liquid should be clean in such aspects that any content of dregs are less than 1/100 of the content in the green liquor to be filtered.

According to one further aspect of the inventive method is also a cake of precoat maintained on the filter surface during the intensified wash out process. The wash out process ending each cycle after green liquor separation is intended to flush out the vat of the separating apparatus with the objective to flush out any dregs accumulated in the vat, while maintaining the precoat so that the following white liquor separation process could start immediately after termination of the wash out process.

According to yet a further embodiment of the inventive method is also a total removal of the precoat on the common filter apparatus including a filter cloth wash activated after two or more green liquor separation cycles and wherein a total new precoat is established in subsequent white liquor separation process in said common filter apparatus. In some cases could as many as up to 3-4 green liquor separation cycles be performed in sequence, interrupted by white liquor separation cycles in between, before a total removal of the precoat is activated. The number of green liquor cycles possible is dependent on the current status of the green liquor or the causticized white liquor as of impurities and is very much specific for each mill and current type of kraft pulping operation.

DETAILED DESCRIPTION OF THE INVENTION

Figure 1:
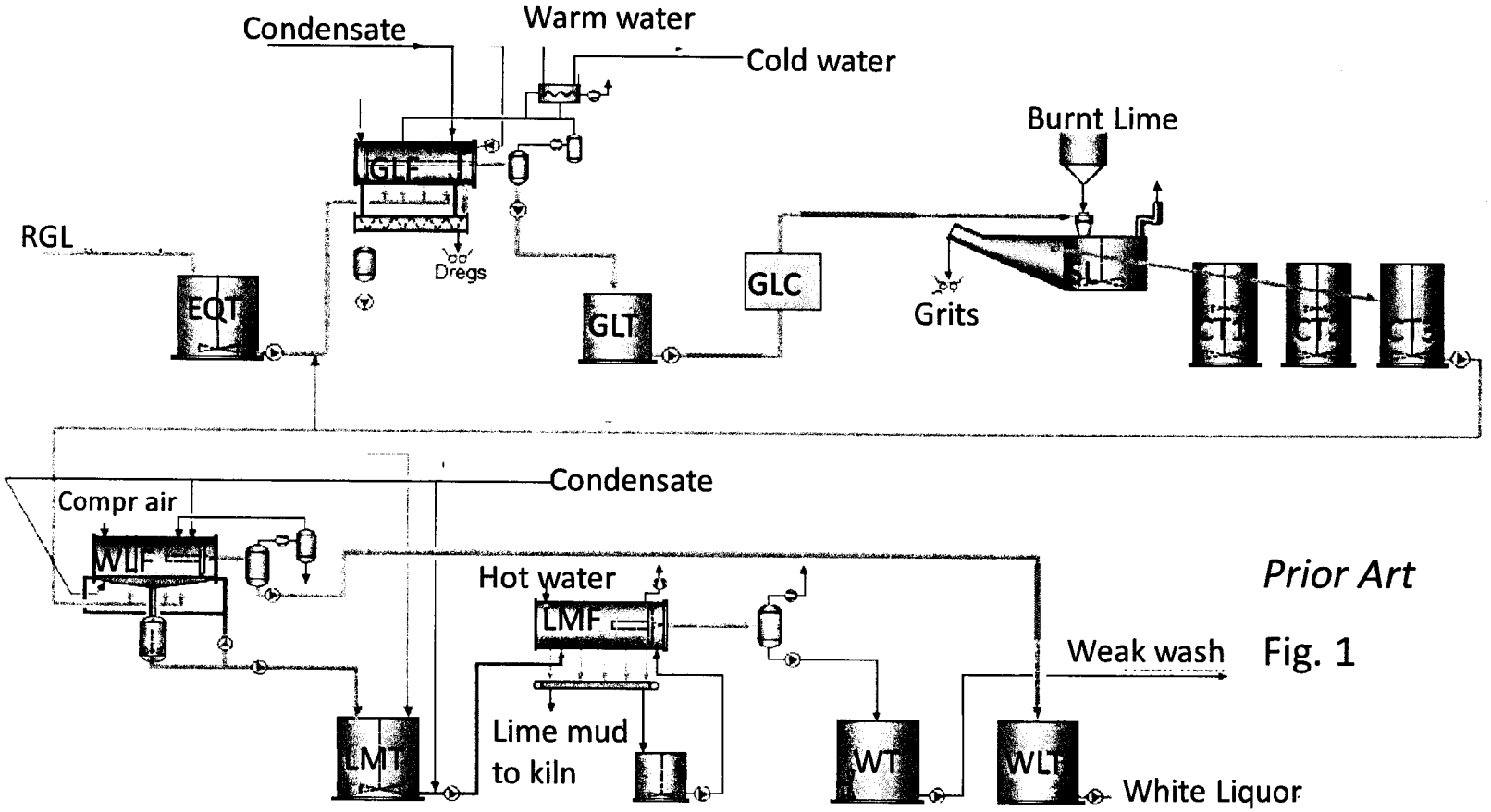
Prior Art Fig. 1
FIG. 1 is a schematic representation of a conventional causticizing process.
Figure 2:
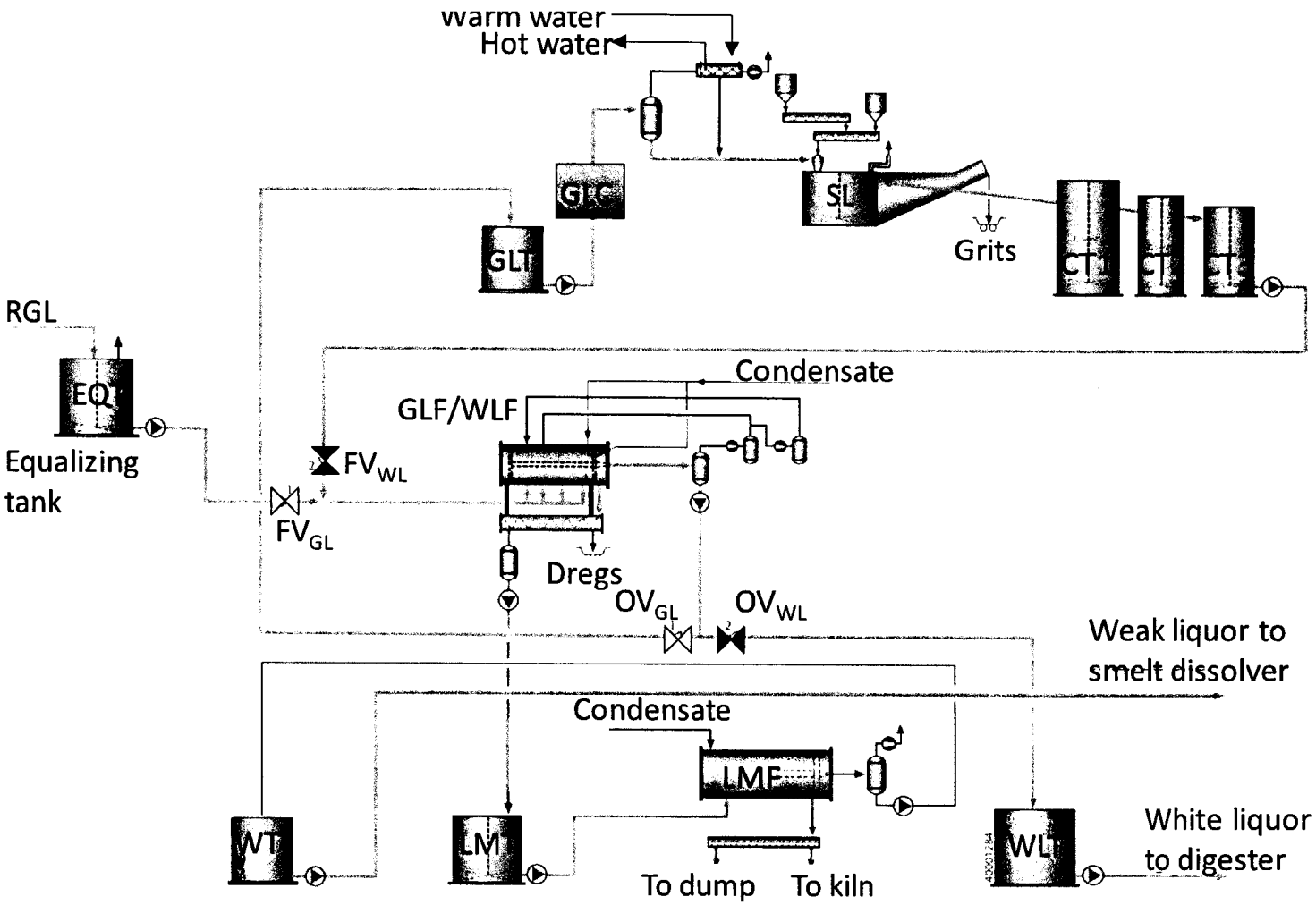
FIG. 2 is a schematic representation of the causticizing process according to the invention.

The inventive method is described in connection with a system set up as shown in FIG. 2. In here is one single common filter apparatus GLF/WLF used for the green and white liquor cycles.

The raw green liquor RGL is first received in an equalizing tank EQT and from there pumped to the green liquor separation process when the feed valve for green liquor $FV_{GL}$ is open and the feed valve for white liquor $FV_{WL}$ is closed (black valves indicate closed status). The separation process is here shown implemented in a pressurized disc filter GLF/WLF. The common filter apparatus GLF/WLF now operating as a green liquor filter separates out dregs from the raw green liquor and produces clear green liquor sent to a green liquor storage tank GLT when the output valve for green liquor $OV_{GL}$ is open and the output valve for white liquor $OV_{WL}$ is closed. The clear green liquor is then sent, most often via a green liquor cooler GLC, to the slaker SL where burnt lime is mixed into the green liquor. The cooler is needed to reduce temperature to well below boiling point as the reactions occurring in and after the slaker are exothermic. Grits, i.e. unreacted components from the burnt lime, are also separated out from the slaker. After mixing in the slaker the mixture is sent to a series of causticizing vessels CT1-CT2-CT3, often named the causticizing train, wherein the chemical causticizing reactions are completed. As the feed valve for white liquor $FV_{WL}$ is closed the vessels CT1-CT2-CT3, preferably only the last vessel CT3, are used as storage vessels for the causticizised liquor when the common filter apparatus GLF/WLF is used as a green liquor filter during the green liquor cycle.

When the storage vessel CT3 is reaching the upper storage capacity limit, the common filter is switching to white liquor filtration. During the white liquor filtration the feed valve for green liquor $FV_{GL}$ is closed and the feed valve for white liquor $FV_{WL}$ is opened, while the output valve for green liquor $OV_{GL}$ is closed and the output valve for white liquor $OV_{WL}$ is opened. During the white liquor cycle the liquid is pumped from storage vessel CT3 to a white liquor separation process in the common filter apparatus GLF/WLF, here shown as a white liquor pressurized disc filter. During the white liquor cycle the filter separates out lime mud from the caustiziced liquor and produces clear white liquor sent to a white liquor storage tank WLT. The clear white liquor is then sent directly to be used in the kraft cooking or bleaching line, or alternatively via a polysulfide modification process to said kraft cooking. The lime mud, which still may have a residual content of alkali, is sent to a lime mud washing and drying stage, here shown as a lime mud pressurized disc filter LMF. Once the lime mud is washed and dried it may be passed to the lime kiln in order to convert it to burnt lime to be used in the slaker again.

Figure 3:
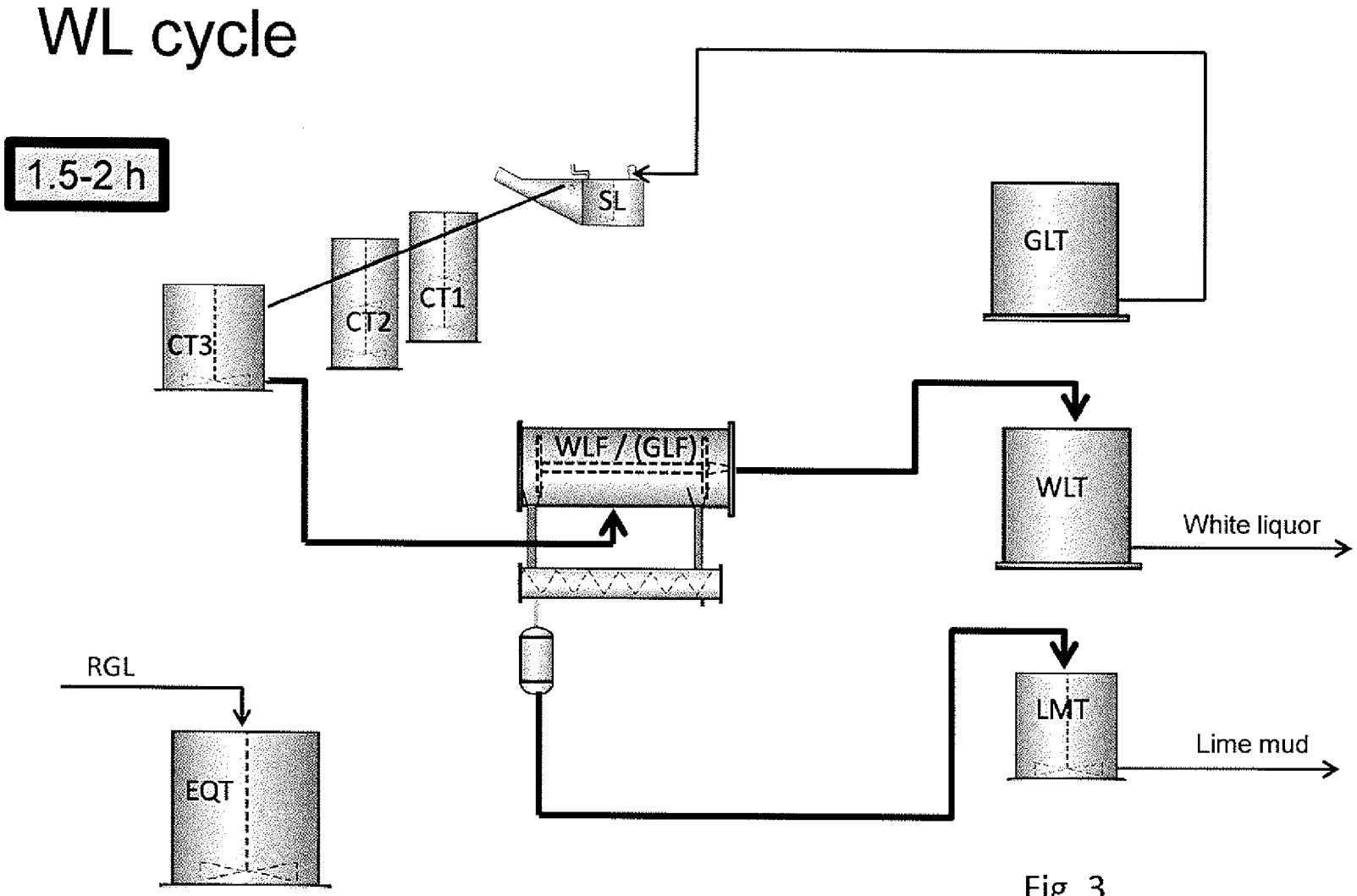
FIG. 3 is showing the liquor flows during the white liquor cycle according to the invention.

In FIG. 3 only the flows during the white liquor cycle are shown when operating the common filter apparatus GLF/WLF. This cycle is preferably initiated during 1.5-2 hours, during which the equalizing tank EQT for receiving raw green liquor RGL is only used as buffering tank, i.e. with no outflow of any raw green liquor. As no filtered green liquor is produced, the green liquor tank GLT is in an emptying process, feeding clear green liquor to the slaker and onwards via the causticizing train CT1-CT2-CT3 to the common filter apparatus GLF/WLF. The resulting filtered white liquor is fed from the common filter apparatus GLF/WLF to the white liquor tank WLT.

Figure 4:
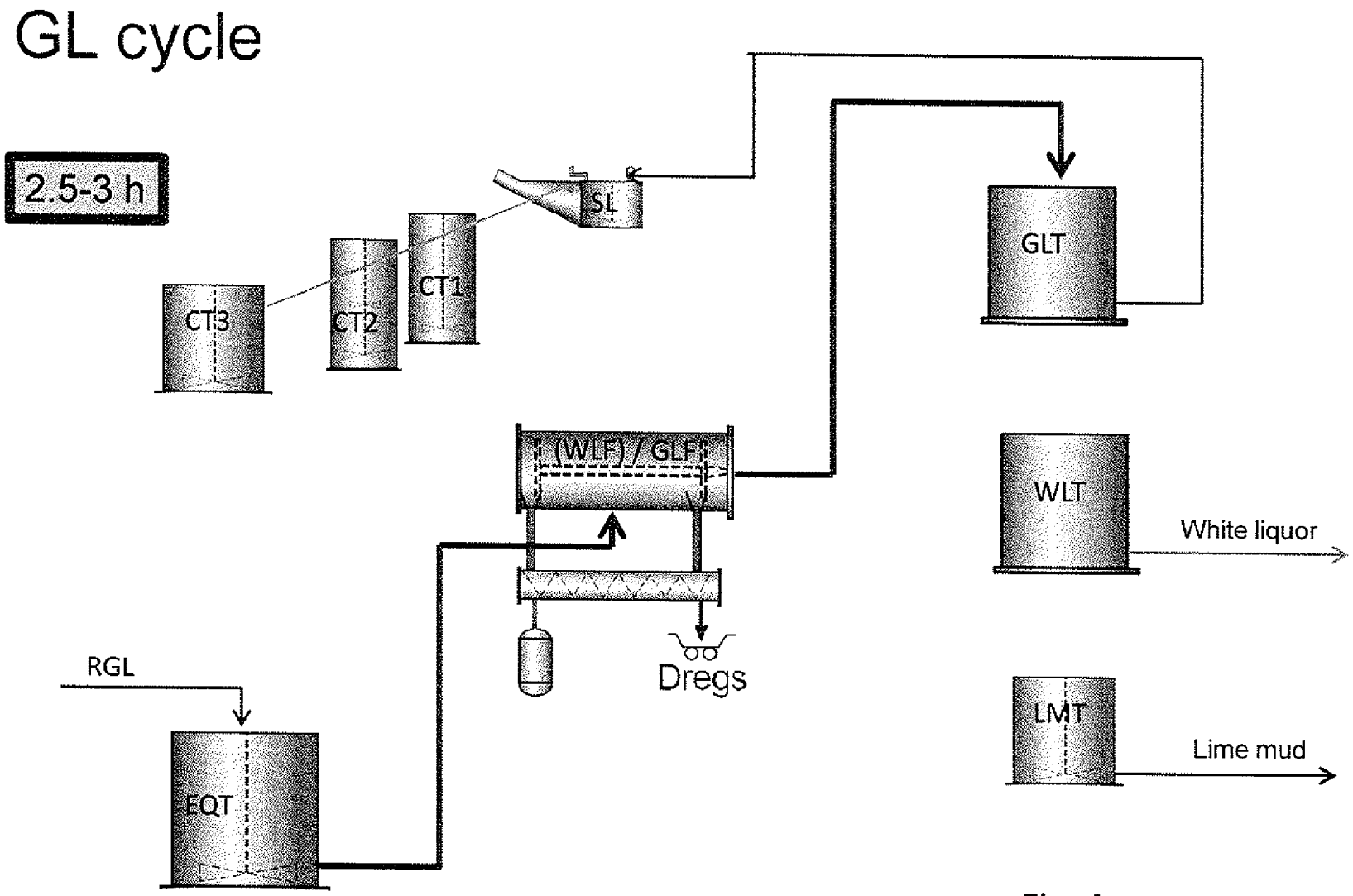
FIG. 4; is showing the liquor flows during the green liquor cycle according to the invention.

In FIG. 4 only the flows during the green liquor cycle are shown when operating the common filter apparatus GLF/WLF. This cycle is preferably initiated during 2.5-3 hours, during which the causticizing train CT1-CT2-CT3 for receiving causticizised liquor is only used as buffering tank, i.e. with no outflow of any causticizised liquor. As no filtered white liquor is produced, the white liquor tank WLT is in an emptying process, feeding clear white to the cooking or bleaching process in the kraft pulping process. Raw green liquor RGL is fed from the equalizing tank EQT to the common filter apparatus GLF/WLF. The resulting filtered green liquor is fed from the common filter apparatus GLF/WLF to the green liquor tank GLT.

Figure 5:
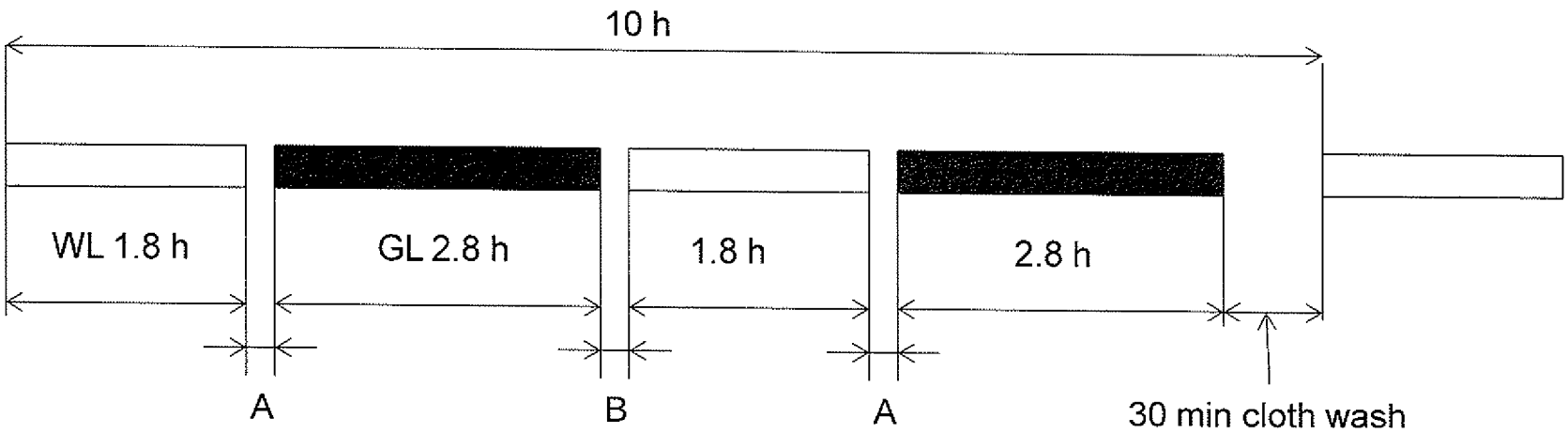
FIG. 5; is showing a typical sequence with white- and green liquor cycles according to the invention.

In FIG. 5 are shown a number of white and green liquor cycles in sequence operated according to the inventive method. Typically within a 10 hour total cycle there are preferably a first white liquor cycle during 1.8 hours followed by a first green liquor cycle during 2.8 hours, and repeated with a subsequent second white liquor cycle during 1.8 hours followed by a second green liquor cycle during 2.8 hours. After the white liquor cycles there are preferably only an emptying of the common filter apparatus GLF/WLF from causticizised white liquor during the time interval A. But after the green liquor cycles there are preferably not only an emptying of the common filter apparatus GLF/WLF from raw green liquor during the time interval B, but also an improved addition of an intensified wash out process using a volume of washing liquid of at least 5% of the liquor volume held in the vat of the common filter apparatus during filtering. As indicated before, the washing liquid should not contain any larger amounts of dregs, as the objective is to flush out any dregs that may have settled into the vat of the filter apparatus, whose presence may have a negative impact during the start of the white liquor cycle and formation of a precoat with only lime mud on the filter cloth of the filtering apparatus. If any dregs are still kept in the common filtering apparatus when filling it up with causticized liquor, these dregs residuals may be suspended in the causticized liquor and then remain in the precoat formed, thus reducing the filtering capacity. In order to flush out any dregs should preferably also said intensified wash out process be complemented by intense agitation in the liquid volume held in the common filter apparatus. This could be implemented by any intense recirculation inside the vat of the common filtering apparatus or adding the washing liquid trough so called mammoth pumps located in the bottom area of the vat. The mammoth pumps are during filtering operations fed with pressurized air in order to prevent settling in the vat, and looks like an educator nozzle that is driven by the air flow and which induce a suction effect around the nozzles at the bottom wall of the vat.

As indicated in FIG. 5 is also a total renewal of the precoat including a thorough cloth wash implemented after a last green liquor cycle, here indicated as a 30 minutes cloth wash.

Figure 6:
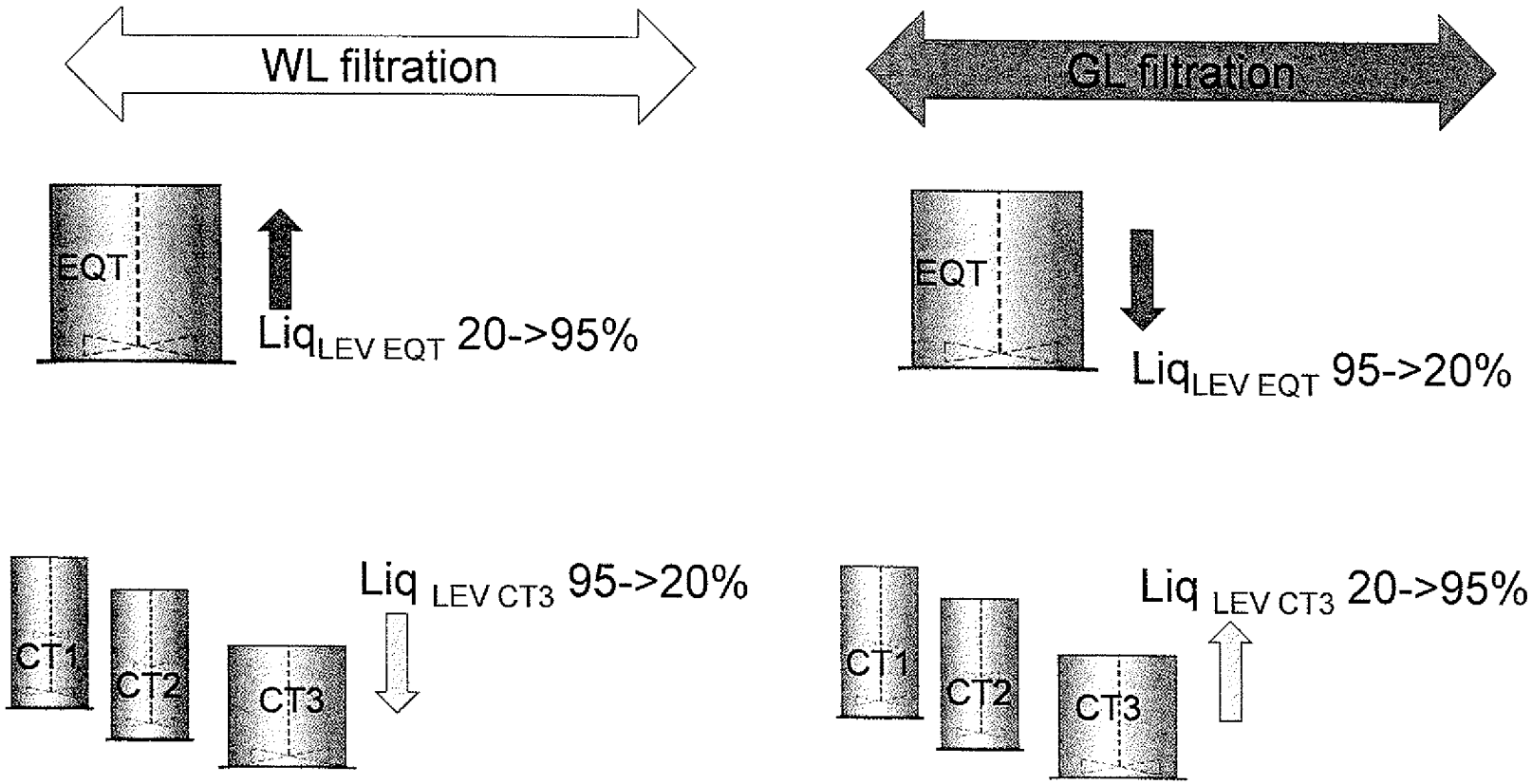
FIG. 6; is showing the usage in buffer tanks during green and white liquor cycles according to the invention.

In FIG. 6 are shown how the equalizing tank EQT and the last tank CT3 in the causticizing train CT1-CT2-CT3 are used as buffer tanks during the white liquor cycle (left hand part of figure) and the green liquor cycle/right hand side of figure). During the white liquor cycle the liquid level in the equalizing tank EQT is rising from a level of 20% and up to about 95%, while the liquid level in CT3 is dropping from a level of 95% and down to about 20%. In the subsequent green liquor cycle the opposite effect occurs, i.e. the liquid level in the equalizing tank EQT is dropping from a level of 95% and down to about 20%, while the liquid level in CT3 is rising from a level of 20% and up to about 95%.

Figure 8:
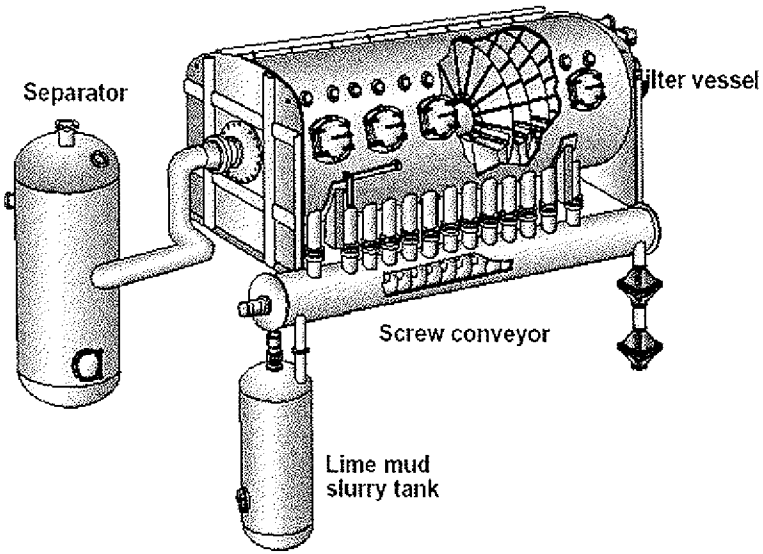
FIG. 8; is showing a typical disc filter apparatus preferably used for the common filter apparatus.
Figure 7:
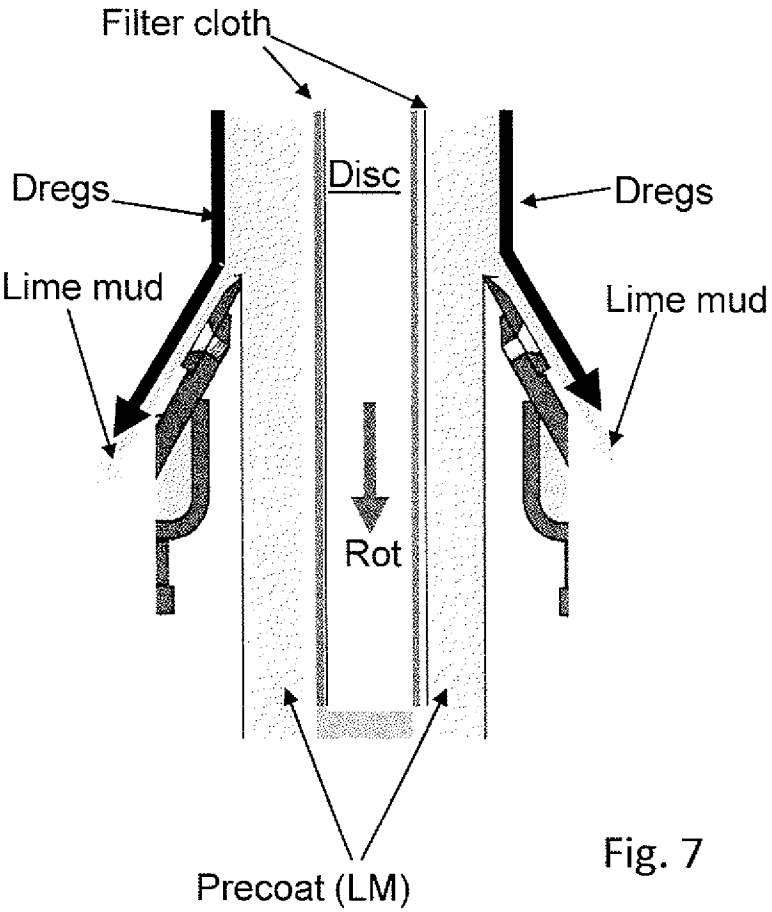
FIG. 7; is showing precoat removal on filter surfaces of the common filter apparatus.

In FIG. 7 is shown a filter disc section used in a disc filter apparatus as shown in FIG. 8. Knives located on each side of the rotating disc, are scraping off an outer layer of the precoat. In FIG. 7 is shown the principle constitution of the precoat after a green liquor cycle, where an outermost layer of dregs has been caught on top of the lime mud base precoat. The knives advance a little bit into the lime mud base precoat and create a clean lime mud surface for the following white liquor cycle. During the white liquor cycle the knives are retracted allowing the lime mud base precoat to build up again in thickness.

In a preferred mode of operation, the knives are located about 12 mm from the filter cloth during start of WL filtration and is retracted to position about 22 mm when a precoat of lime mud is built up on the filter cloth. At the end of the WL filtration period a lime mud precoat with a thickness of 22 mm is thus established. When GL filtration is started, the knives are successively moved towards the filter cloth and when reaching a distance of 12 mm the GL filtration stops. WL filtration starts by moving the knives to a distance of 10 mm in order to expose a fresh lime mud precoating and rebuilding a new lime mud precoat with 22 mm thickness.

In a test of the inventive method using a cycle sequence as shown in FIG. 5, the total cycle time was about 619 minutes (the "10 h" in figure). In this total cycle the WL filtration was about 230 minutes, i.e. 37% of the total cycle, and the GL filtration about 330 minutes, i.e. 53% of the total cycle. The rest of the total cycle, about 10%, is non productive time (A, B and 30 min cloth wash in FIG. 5). In the test a common filter apparatus was used with a pressurized disc filter, see FIG. 8, having a total filter area of 280 $m^2$ and a vat holding some 55 $m^3$ liquor to be filtered, producing 5 100 $m^3$ WL/day and 5 350 $m^3$ GL/day.

While the present invention has been described in accordance with preferred compositions and embodiments, it is to be understood that certain substitutions and alterations may be made thereto without departing from the spirit and scope of the following claims.

We claim:

1. A method for preparation of white liquor in a chemical recovery process of the kraft process, comprising:

raw green liquor is first fed to a green liquor separation process wherein dregs are separated out and a clear green liquor is obtained, thereafter adding burnt lime to the clear green liquor in a slaker, followed by a causticizing train with a number of causticizing vessels wherein the causticizing process is finished producing a causticized liquor, thereafter sending the causticized liquor to a white liquor separation process wherein lime mud is separated out and a clear white liquor is obtained to be used as cooking liquor in the kraft process either in form of the clear white liquor or as modified by polysulfide modification in a polysulfide process, and wherein the separated lime mud is sent to a lime mud washing and drying process before feeding the washed and dried lime mud to a lime kiln, the green liquor separation process and the white liquor separation process taking place in the same common filter apparatus with no dedicated green liquor separation apparatus or any dedicated white liquor separation apparatus, and where the white liquor separation process and the green liquor separation process are conducted in sequence in the same filter apparatus and where the white liquor separation process has a part of the cycle time in the range 20-50% of the total cycle time in the same filter apparatus.

2. The method according to claim 1, wherein an equalizing buffer tank is preceding the green liquor separation process and where the equalizing buffer tank has a storage capacity holding raw green liquor for at least 5 hours in said equalizing buffer tank, and where a last buffer tank in the causticizing train has a storage capacity holding a causticized liquor for at least 2 hours in said last buffer tank in the causticizing train.

3. The method according to claim 2, wherein the equalizing buffer tank is filled with raw green liquor while emptying the buffer tank in the causticizing train when performing the white liquor separation in the common filter apparatus, and thereafter emptying the equalizing buffer tank of raw green liquor while filling the buffer tank in the causticizing train when performing the green liquor separation in the common filter apparatus.

4. The method according to claim 3, wherein the level of liquors in the buffer tanks is controlled within 20-95% of the total retention capacity during white and green liquor separation.

5. The method according to claim 1, wherein said the green liquor separation process in said common filter apparatus is ended by a complete emptying of raw green liquor and addition of an intensified wash out process using a volume of washing liquid at least 5% to that of the liquor volume held in the common filter apparatus during filtering, said washing liquid not containing any dregs, said intensified wash out process also complemented by intense agitation in the liquid volume held in the common filter apparatus.

6. The method according to claim 5, wherein the volume of washing liquid used during the intensified wash out process exceeds 3 $m^3$.

7. The method according to claim 6, wherein a cake of pre-coat is maintained on the filter surface during the intensified wash out process.

8. The method according to claim 1, wherein a total removal of the pre-coat on the common filter apparatus including a filter cloth wash is activated after 2 or more green liquor separation cycles and wherein a total new pre-coat is established in subsequent white liquor separation process in said common filter apparatus.

* * * * *